United States Patent [19]

Salzer

[11] 4,034,328

[45] July 5, 1977

[54] ELECTRIC FUSE

[76] Inventor: Erwin Salzer, P.O. Box 45, Waban, Mass. 02168

[22] Filed: June 28, 1976

[21] Appl. No.: 687,741

[52] U.S. Cl. ..... 337/159; 337/276; 337/295

[51] Int. Cl.[2] ..... H01H 33/02

[58] Field of Search ..... 337/158, 159, 161, 187, 337/190, 194, 276, 290, 293, 295; 317/40 A

[56] References Cited

UNITED STATES PATENTS

| | | | |
|---|---|---|---|
| 3,810,061 | 5/1974 | Salzer | 337/290 |
| 3,843,948 | 10/1974 | Kozacka | 337/158 |
| 3,870,984 | 3/1975 | Salzer | 337/161 |
| 3,881,161 | 4/1975 | Kozacka | 337/161 |

*Primary Examiner*—William H. Beha, Jr.
*Attorney, Agent, or Firm*—Erwin Salzer

[57] ABSTRACT

Electric fuses having supports for their fusible element or elements which supports are formed of bundles of glass fibers in form of cords, rovings, or the like glass fiber structures made up of fibers which extend but in longitudinal direction, i.e. do not include fibers which extend in transverse direction. The fibers are under considerable stress in longitudinal direction, so as to form a supporting structure of considerable dimensional stability. The terminal elements of the fuse are preferably in the form of terminal plugs and provided with means to control the stress to which the glass fibers are subjected. The latter may be impregnated with chemical compounds that evolve protective and arc-quenching gases under the heat of electric arcs.

9 Claims, 16 Drawing Figures

ELECTRIC FUSE

BACKGROUND OF THE INVENTION

Electric fuses having one or more fusible elements, in particular helically wound fusible elements, have generally supports in insulating material for supporting the fusible element or elements. In the past such supports have been the source of great difficulties. It is generally desirable to make such supports of a high grade ceramic material and, as a result, the cost of such supports is high. A further serious limitation consists in that their bulk either limits seriously the amount of arc energy absorbing filler that can be placed into a fuse casing of given size, or precludes size limitation or reduction which is often an essential requirement.

This situation gave rises to the problem of evolving fuses having one or more helically wound fusible elements which would not require a mandrel-like insulating support and yet allow provision of extremely thin, extremely fragile fusible elements wound according to any desired diameter. The process disclosed and claimed in my U.S. Pat. No. 3,848,214; Nov. 12, 1974 for METHOD OF ASSEMBLING ELECTRIC HIGH VOLTAGE FUSES AND SUBASSEMBLY THEREFORE makes it possible to manufacture fuses wherein the helically wound fusible element or elements are supported only by the granular arc-quenching filler by which they are surrounded in the absence of any mandrel-like fusible element support.

The performance of fuses manufactured in accordance with the above patent has proven to be satisfactory. However, the manufacture thereof may require under certain circumstances particular care. In the fuse structure wherein the healically wound fusible element or elements are permanently supported by mandrel-like structure the process of filling the casing of the fuse with granular arc-quenching filler is less critical than in a fuse lacking a permanent mandrel-like supporting structure wherein the function of supporting the fusible element or elements is ultimately solely assigned to the granular arc-quenching filler or quartz sand by which they are surrounded.

In fuses manufactured in accordance with U.S. Pat. No. 3,848,214 the helical windings of the fusible element or elements are initially formed on a squirrel-cage-like structure whose element supporting rods are subsequently withdrawn from the windings at a point of time of the manufacturing process when the windings have gained sufficient support from the granular arc-quenching filler by which they are surrounded. Rod withdrawal is an additional process step not normally encountered in the manufacture of highvoltage fuses. If badly performed rod withdrawal may result in damage to extremely fragile fusible elements. Rod withdrawal results in the formation of voids which voids must not exceed a certain critical volume and timely be filled with granular arc-quenching filler.

It is, therefore, a prime object of this invention to provide electric fuses having fusible elements, in particular one or more helically wound fusible elements, which fuses are not subject to the limitation of prior art fuses having mandrel-like fusible element supports, and which fuses can be manufactured at smaller cost than fuses manufactured in accordance with U.S. Pat. No. 3,848,214.

Another object of the invention is to provide electric fuses having one or more helically wound fusible elements that are supported by a low cost mandrel-like support combining a minimum of bulk with sufficient dimensional stability.

Other objects and advantages of the invention will become more apparent as this specification proceeds.

DESCRIPTION OF PREFERRED EMBODIMENTS

Figure 1:
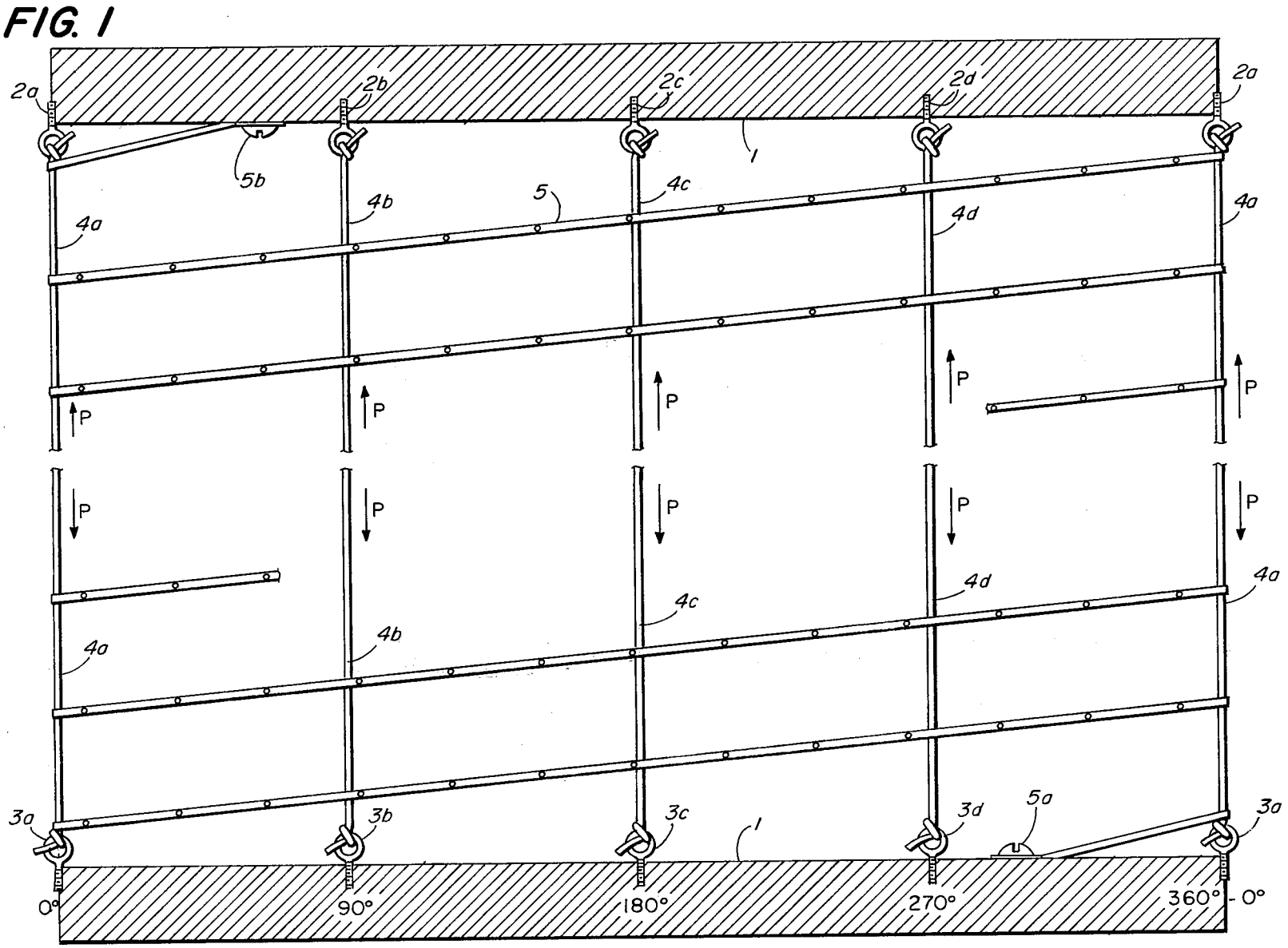
FIG. 1 is a diagrammatic representation of a fuse embodying the present invention.

In fuses embodying this invention the tubular casing of electric insulating material is preferably closed by a pair of plug terminals. Fuses having plug terminals are well known in the art and are disclosed, for instance, in my above referred-to patent and in U.S. Pat. 3,851,289; Nov. 26, 1974 to Frederick J. Kozacka for HIGH-VOLTAGE FUSE HAVING HELICALLY WOUND FUSIBLE ELEMENT AND SUPPORT FOR HELICALLY WOUND FUSIBLE ELEMENT. In FIG. 1 a pair of such plug terminals has been indicated by rectangles 1. Rectangles 1 are cylindrical sections of a pair of coaxially arranged pair of plug terminals taken at regions situated about midway between the axes of the plug terminals and the periphery thereof. These sections have been developed into the plane of the paper of which FIG. 1 is drawn. The upper plug terminal 1 is provided with four screw-eyes or the like fasteners 2*a*,2*b*,2*c*,2*d* which are angularly displaced 90°. In like fashion the lower plug terminal 1 is provided with four screw-eyes 3*a*,3*b*,3*c*,3*d* which are angularly displaced 90°. The aforementioned screw-eyes are arranged in registering pairs 2*a*,3*a*; 2*b*,3*b*; 2*c*,3*c*; 2*d*,3*d*. The lines interconnecting the above pairs of screw-eyes are the longitudinal edges of a prism that is square in cross-section. Screw-eyes 2*a*,3*a* are tied together by a length of cord 4*a* of glass fibers. This length of cord 4*a* is placed under considerable stress in a direction longitudinally thereof. This may be achieved by various means which will be described below in detail. In like fashion the pair of screw-eyes or the like fasteners 2*b*,3*b* are tied together by a length of cord 4*b* of glass fibers, the pair of screw-eyes or like fasteners 2*c*,3*c* are tied together by a length of cord 4*c* of glass fibers, and the pair of screw-eyes 2*d*,3*d* are tied together by a length of cord 4*d* of glass fibers. The length of cords 4*b*,4*c*,4*d* of glass fibers are also under considerable stress in a direction longitudinally thereof as indicated by the arrows P. A fusible element 5, preferably in form of a perforated ribbon of silver, is wound substantially helically around the four stressed lengths 4*a*,4*b*,4*c*,4*d* of glass fiber cord. Fusible element 5 conductively interconnects the pair of plug terminals 1. Reference character 5*a* has been applied to indicate the point where fusible element 5 is conductively connected to the lower plug terminal 1 and reference character 5*b* has been applied to indicate the point where fusible element 5 is conductively connected to the upper plug terminal 1.

It will be apparent that the glass fiber cord supporting structure 4*a*,4*b*,4*c*,4*d* for fusible element 5 could be formed by one single length of glass fiber cord having but two ends rather than four separate lengths of glass fiber cord of which each length has two ends. The latter alternative makes it relatively easier to impart high and equal stresses to the four lengths 4*a*,4*b*,4*c*,4*d*, which is of particular importance where the spacing between plug terminals 1 is considerable.

Figure 2:
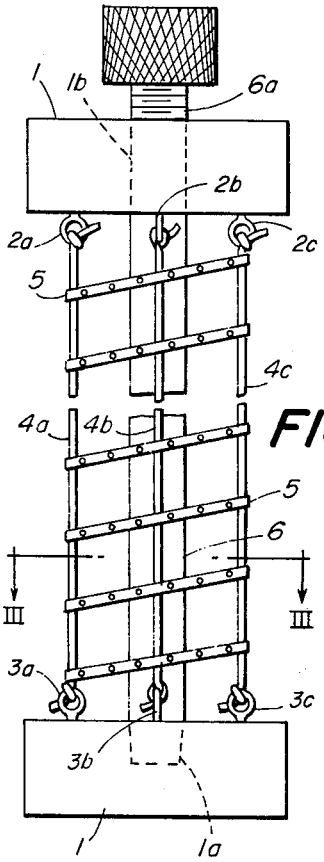
FIG. 2 is a side elevation of a subassembly intended to form, and forming, a support for a helically wound fusible element.
Figure 3:
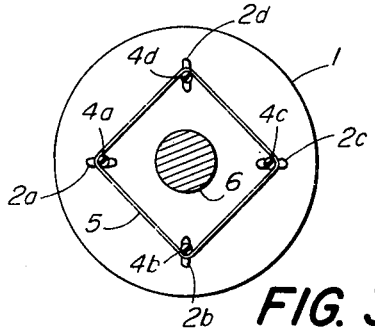
FIG. 3 is a section along III—III of FIG. 2.

FIGS. 2 and 3 illustrate a sub-assembly for manufacturing fuses embodying this invention. In these two figures the same reference characters as in FIG. 1 have been applied to indicate like parts. Reference character 1 has been applied to indicate a pair of coaxially arranged cylindrical plug terminals intended to plug the ends of a tubular casing or fuse tube. Terminals 1 are spaced by a spacing column or center post 6. Lower plug terminal 1 has a recess 1*a* in the shape of a frustum of a cone into which the lower flexible end of spacing column or center post 6 projects. The upper terminal has in its center a bore 1*b* which is internally screw-threaded. Center post 6 has a screw-threaded portion 6*a* engaging the screw-threaded bore 1*b* in upper plug terminal 1. This combination of parts has been described in my aforementioned U.S. Pat. No. 3,848,214 in greater detail. As also shown in FIG. 1, the upper terminal element 1 is provided with four screw-eyes 2*a*,2*b*,2*c*,2*d* and the lower terminal element 1 is provided with four screw-eyes 3*a*,3*b*,3*c*,3*d*. Stressed spaced cords 4*a*,4*b*,4*c*,4*d* of glass fibers interconnect the pairs of screw-eyes 2*a*,3*a*;2*b*,3*b*;2*c*,3*c*;2*d*,3*d*.

Figure 3A:
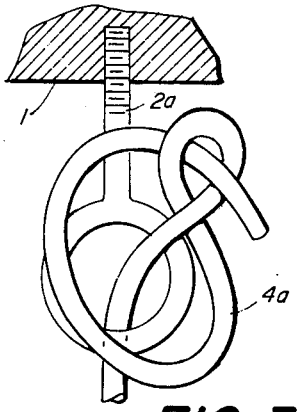
FIG. 3*a* shows the formation of a knot for affixing a cord or the like to a screw-eye, hook, or like fastener.

FIGS. 1–3 do not show in detail how the cords or strings 4*a*–4*d* are attached to the screw-eyes 2*a*–2*d* and 3*a*–3*d*, respectively, which also might be replaced by rounded hooks. Any appropriate kind of knot may be used to this end. FIG. 3*a* shows a screw-eye and the formation of a knot for affixing the end of a cord to it.

Figure 4:
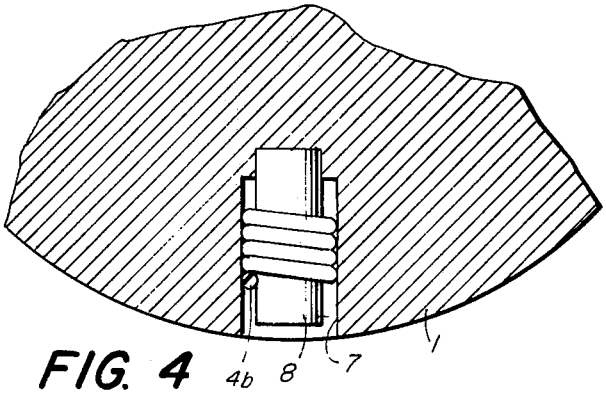
FIG. 4 shows a portion of a plug terminal of a fuse embodying the present invention and is a section along IV—IV of FIG. 5.
Figure 5:
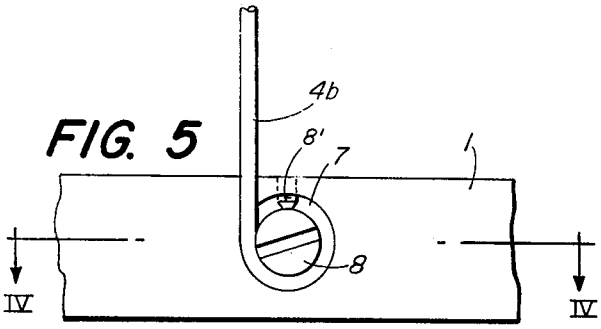
FIG. 5 is a side elevation of the structure of FIG. 4.

Referring now to FIGS. 4 and 5, numeral 1 has been applied to indicate a portion of the lower of the two plug terminals 1 included in a fuse embodying this invention. Plug terminal 1 is provided with four radical bores 7 which are angularly displaced 90° and of which but one is shown in FIGS. 4 and 5. A pin 8 which may be referred-to as winch pin is pivotally arranged in each bore 7. Cord 4*b* whose upper end is affixed to a screw-eye or hook — as shown in FIGS. 1–3 — is wound around winch pin 8 and may be tightened to any desirable extent by pivoting winch pin 8 in counterclockwise direction, as seen in FIG. 5. When the desired stress is imparted to glass fiber cord 4*b*, winch pin 8 is held in position by means of set-screw 8′, thus permanently maintaining cord 4*b* in the desired state of tension. Cords 4*a*,4*c* and 4*d* may be stressed and maintained in the desired state of stress in the same way as cord 4*b*.

Figure 6:
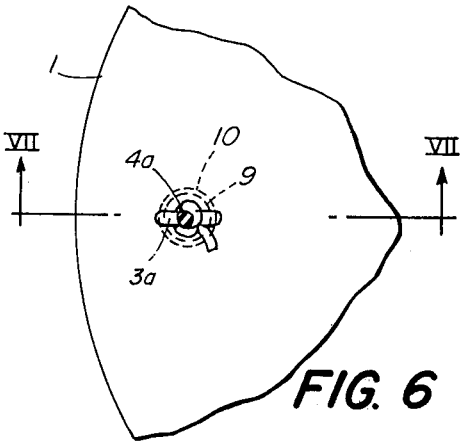
FIG. 6 is a top-plan view of a portion of another plug terminal of a fuse embodying the present invention.
Figure 7:
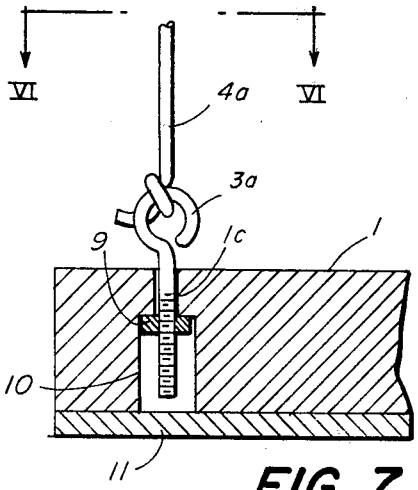
FIG. 7 is a section along VII—VII of FIG. 6 and shows an adjustable screw eye in side elevation.

The structure shown in FIGS. 6 and 7 is intended to achieve the same end as that shown in FIGS. 4 and 5, i.e. to put any of cords 4*a*–4*c* under stress and to maintain it in the desired degree of stress. The screw-eyes or hooks 2*a*–2*d* in the upper terminal plug 1 may be fixed and the screw-eyes 3*a*–3*d* in the lower terminal plug 1 adjustable (See also FIG. 1). FIGS. 6 and 7 illustrate such an adjustable screw-eye 3*a* in lower terminal plug 1 for tightening glass fiber cord 4*a*. Terminal 1 is provided with four bores 1*c* which are angularly displaced 90° and of which are one bore 1*c* has been shown in FIGS. 6 and 7. The shank of screw-eyes 3*a* is screw-threaded, projects through bore 1*c* and supports an adjustment nut 9 arranged in a cavity 10 of terminal plug 1. Nut 9 abuts against plug 1 and turning of nut 9 allows to impart the desired stress to glass fiber cord 4*a*. Cavity 10 shown in FIG. 7 and all cavities in terminal plug 1 that correspond to cavity 10 are closed by the common connector strap 11 shown in more detail in FIG. 8.

Figure 8:
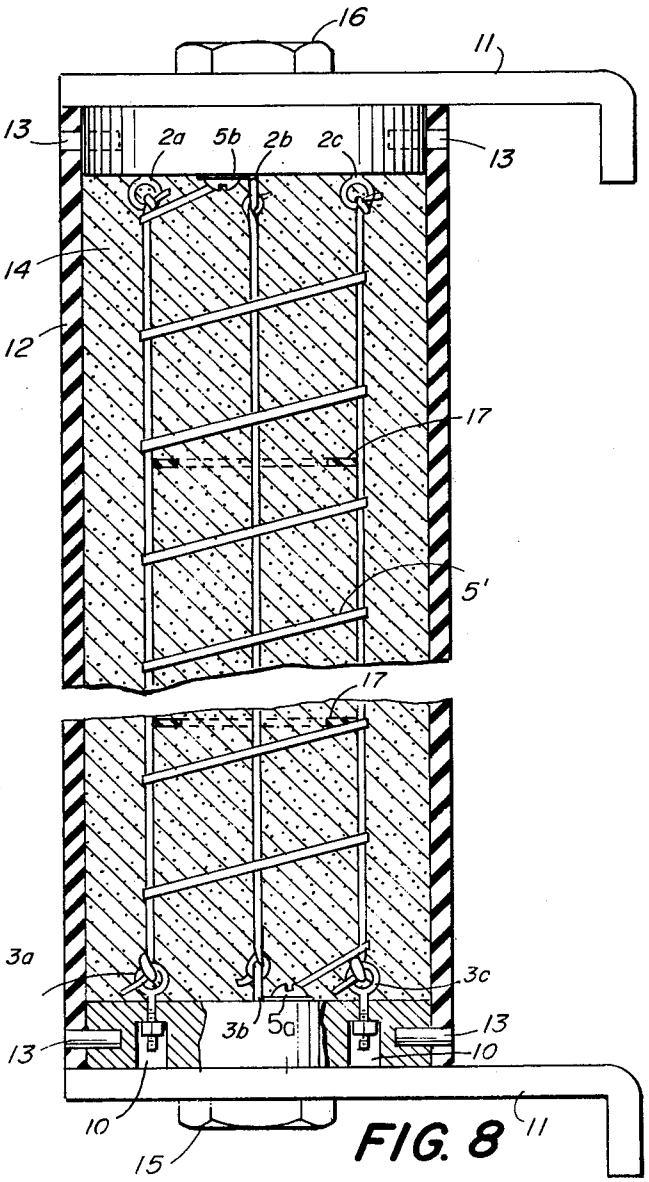
FIG. 8 shows a fuse embodying the present invention, partly in longitudinal section and partly in side elevation.

FIG. 8 shows a complete fuse embodying this invention. The structure of FIG. 8 is obtained from the sub-assembly shown in FIGS. 2 and 3 by mounting the tubular casing 12 on terminal plugs 1, affixing the former to the latter by transverse steel pins 13, removing center post 6 and thereafter filling casing 12 with quartz sand 14, or another granular arc-extinguishing filler. The filling operation is achieved by means of screw-threaded bore 1*b* in upper terminal plug 1(See FIG. 2). The fuse structure of FIG. 8 is completed by affixing connector strap 11 to the axially outer surfaces of terminal plugs 1. The lower connector strap 11 is affixed to the lower terminal plug 1 by a screw 15, and the upper connector strap 11 is affixed to upper terminal plug 1 by a screw 16 having a shank (not shown) that engages the internally screw-threaded bore 1*b* (See FIG. 1) in upper terminal plug 1. The lower terminal plug 1 must be provided with an internally screw-threaded bore for screw 15. A screw-threaded bore may be substituted for the cavity 1*a*, and the lower end of center post 6 provided with an external screw-thread that fits the thread of said bore. In that instance, the same internally screw-threaded bore may serve the dual purpose of receiving the lower end of center post 6 and of receiving the shank of screw 15.

The glass fiber strings 4*a*–4*d* may have a certain tendency to be bent radially inwardly under the pressure of fusible element 5. This tendency may be limited by arranging annular bracing elements 17 along strings 4*a*–4*d* which take up the inward pressure exerted by fusible element 5 upon glass fiber strings 4*a*–4*d*. The annular bracing elements 17 are preferably made of a melamine glass cloth laminate. When the casing 12 is filled with quartz sand 14 the latter drops readily through the central circular apertures defined by bracing elements 17.

Figure 9A:
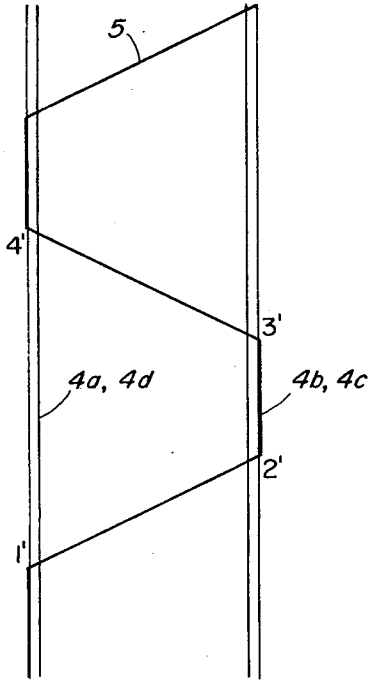
FIGS. 9*a*,9*b*;10*a*,10*b* and 11*a*,11*b* show the effect of winding features of the fusible element upon the performance characteristics of fuses embodying this invention.
Figure 9B:
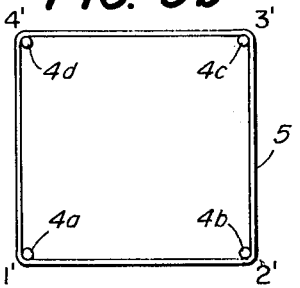

Referring now to FIGS. 9*a*,9*b*,10*a*,10*b* and 11*a*,11*b*, FIG. 9*s* is an elevational view of a fusible element 5 wound helically around four stressed cords 4*a*,4*b*,4*c*,4*d* of glass fibers which define the edges of a prism that is square in cross-section. FIG. 9*b* is a top plan view of the structure of FIG. 9*a*. Considering a specific turn of fusible element 5 beginning at the point 1′ on cord 4*a*, then a full turn includes the four quarter turns or quarter sections:

from point 1′ on cord 4*a* to point 2′ on cord 4*b* from point 2′ on cord 4*b* to point 3′ on cord 4*c*
from point 3′ on cord 4*c* to point 4′ on cord 4*d*
from point 4′ on cord 4*d* to point 1′ on cord 4*a*.

The narrowest spacing along each of cords 4*a*–4*d* of points subject to arcing is equal to the height of one full turn, or a distance equal to that between points 1′ and 4′. The areas of cord 4*a* adjacent points 1′,4′ are more or less subject to the intense heat of the arc taking the place of fusible element 5 and may liquefy more or less as a result of that heat thus truning into a semi-conductor. The length of the cord 4*a* between points 1′ and 4′ is considerable and not all of this length is heated significantly, and hence retains its initial insulating properties.

Figure 10A:
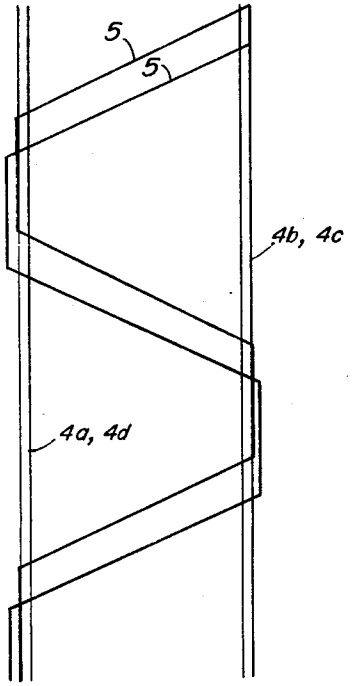
Figure 10B:
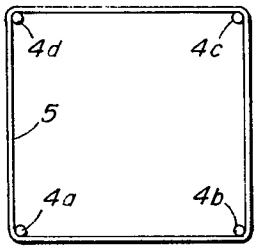

FIG. 10*a* shows, in substance, the same structure as FIG. 9*a* in the same fashion as FIG. 9*a* except for the fact that in FIG. 10*a* two fusible elements 5 are shown to be connected in parallel. Furthermore in FIG. 10 the relation of the cords for supporting the fusible element 5 and the latter have been shown diagrammatically in the interest of greater clarity. FIG. 10*b* is a top plan view of the structure of FIG. 10*a*. It is apparent from FIG. 10*a* that the increase in the number of fusible elements 5 results in an increase of the number of points along cords 4*a*–4*d* which are subject to arcing and intense heating. As shown in FIG. 10*a* the lengths of glass fiber cords 4*a*–4*b* whose insulating properties are not likely to be impaired by arcing are still considerable.

Figure 11A:
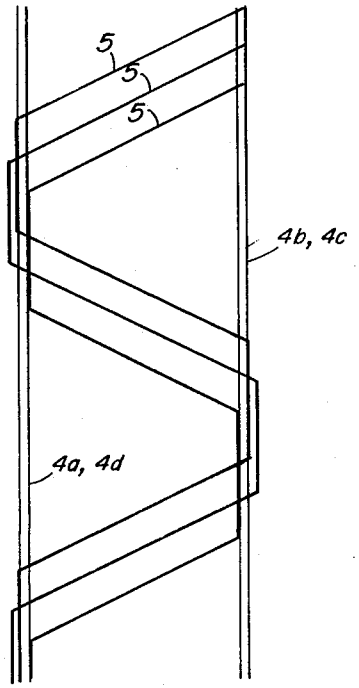
Figure 11B:
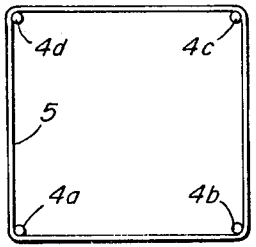

FIG. 11*a* shows in substance the same structure as FIGS. 9*a* and 10*a* in the same fashion as FIGS. 9*a* and 10*a*, except for the fact that three rather than but two fusible elements are shown to be connected in parallel. In FIG. 11*a* the relation of the cords 4*a*–4*d* supporting elements 5 and of the latter has been shown but diagrammatically as in FIG. 10*a*. FIG. 11*b* is a topplan view of the structure shown in FIG. 11*a*. The increase in the number of fusible elements 5 increases further the portion of the total length of cords 4*a*–4*c* that is subject to intense heat and reduces the portion of the total length of these cords that tends to retain its insulating character. There is a limit condition which depends on the pitch of the windings 5, their number, the arc energy released during interruption and other parameters when the stressed glass fibers 4*a*–4*d* fail dielectrically.

One way to cope with this situation is to avoid its occurrence. Another better way is to impregnate the element supports 4*a*–4*d* of stressed glass fibers with a medium that evolves gases under the heat of electric arcs. Such gases form thermal insulating shields around the element supports 4*a* –4*d* that preclude the latter from reaching dangerous temperatures, i.e. temperatures tending to seriously impair the insulating characteristics thereof. All other conditions remaining unchanged, the conductivity of a stressed glass fiber support at elevated temperatures increases with the cross-sectional area of the support. Imparting an excessive cross-sectional area to the stressed glass fiber support may lead to failure of the fuse. The tensile strength of glass fiber is so high as to make it possible to stress the fibers sufficiently to impart the necessary degree of dimensional stability to the support, without resorting to excessive cross-sectional areas. In instances where the glass fibers are impregnated with a synthetic resin, e.g. melamine resin, evolving protective, or arc-quenching, gases under the heat of electric arcs, the ratio of synthetic resin to glass has an important effect on performance. It is further desirable to add inorganic, non-tracking substances to the synthetic impregnating resin, a measure which is generally known in the art.

The prime purpose of the impregnation of the glass fibers under stress is the interposition of a gaseous thermal insulation between the arcs and the glass fiber supports. The gases resulting from such impregnation may be selected to have desirable secondary effects. Impregnation with melamine resins is desirable on account of the fact that it can readily be achieved and that the gaseous media resulting from the breakdown of melamine resins are nitrogen rich. The gaseous media resulting from vaporization of substances used for impregnating stressed cords 4*a*–4*d* diffuse into the arc and thereby contribute to the de-ionization of the arc path. If desired, the stressed cords 4*a*–4*d* may be impregnated with well known substances evolving electronegative gases.

The selection of the nature of the stressed glass fiber support may have an effect upon the performance of the fuse. It is impermissible to use glass fibers that are impregnated with a substance that has a tendency to track.

Figure 12:
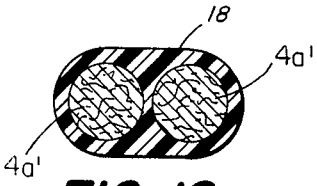
FIG. 12 shows a cross-section on a larger scale a detail of a modification of the structures previously described.

FIG. 12 shows a cross-section of two parallel glass fiber cords 4*a*′ which may take the palce of a single stressed glass fiber cord 4*a*,4*b*,4*c*,4*d* shown in FIGS. 1, 2, 3 and 8. As shown in FIG. 12, a body of gas-evolving material 18 surrounds cords 4*a*′ and fills the narrow gap which is left therebetween.

A glass fiber cord may be under considerable stress and exhibit a considerable degree of stiffness during the manufacturing process of a fuse but develop slack upon completion of the assembly process of the fuse and when the fuse is heated by current flow through its fusible element or elements. This has no adverse consequences because at this time the fusible element or elements of the fuse derive adequate support from the granular arc-quenching filler 14 if the filling process has been carried out adequately.

The physical properties of glass fibers in form of rovings, cords, etc. are well known. The curves formed by fusible element supports 4*a*–4*d* are catenaries. This enables to readily calculate fusible element support structures embodying the present invention.

I claim as my invention:

1. An electric fuse including
   a. a tubular casing of electric insulating material;
   b. a pair of terminal elements closing the ends of said casing;
   c. a granular arc-quenching filler inside said casing;
   d. a plurality of spaced flexible cords of glass fibers having ends affixed to said terminal elements and stressed in a direction longitudinally thereof so as to form a relatively stiff system defining the lateral edges of a prism; and
   e. fusible element means inside said casing, embedded in said filler, conductively interconnecting said pair of terminal elements and supported by said stiff system of spaced bundles of glass fibers.

2. An electric fuse as specified in claim 1 including four spaced cords of glass fibers defining the lateral edges of a prism whose cross-section is a square and including fusible element means wound substantially helically around said bundles of glass fibers.

3. An electric fuse as specified in claim 1 wherein at least one of said pair of terminal elements is provided with means for regulating the stress to which said cords of glass fibers are subjected.

4. An electric fuse as specified in claim 3 wherein
a. said pair of terminal elements is formed by a pair of metal plugs inserted into the ends of said casing; and wherein
b. said means for regulating the stress to which said cords of glass fibers are subjected are formed by winch pin means pivotally arranged inside of radially extending bores in one of said pair of plugs and set screws arranged at right angles to said winch pin means.

5. An electric fuse as specified in claim 3 wherein
a. said pair of terminal elements is formed by a pair of metal plugs inserted into the ends of said casing; and wherein
b. said means for regulating the stress to which said cords of glass fibers are subjected are formed by pins having curved ends to which one of the ends of said bundles of glass fibers are affixed, said pins further having straight ends projecting through apertures in one of said pair of metal plugs, being screw-threaded and supporting screw-threaded nuts abutting against said one of said pair of plugs.

6. An electric fuse as specified in claim 1 wherein said spaced cords of glass fibers are impregnated with a substance evolving gases under the heat of electric arcs.

7. An electric fuse as specified in claim 6 wherein said spaced cords of glass fibers are impregnated with a melamine resin including inorganic substances.

8. An electric fuse as specified in claim 1 wherein said cords of glass fibers are formed by glass-fiber cord.

9. An electric fuse as specified in claim 8 wherein each of said cords of glass fibers is formed by two narrowly spaced cords of glass fibers impregnated with a substance evolving gases under the heat of electric arcs.

* * * * *